US008551931B2

(12) United States Patent
Notte et al.

(10) Patent No.: US 8,551,931 B2
(45) Date of Patent: Oct. 8, 2013

(54) SURFACE TREATMENT COMPOSITION CONTAINING PHOSPHONIC ACID COMPOUNDS

(75) Inventors: Patrick Notte, Wavre (BE); Albert Devaux, Mont-Saint-Gulbert (BE); Luc Feyt, Mont Saint-Gulbert (BE)

(73) Assignee: Dequest AG, Zug (CH)

( * ) Notice: Subject to any disclaimer, the term of this patent is extended or adjusted under 35 U.S.C. 154(b) by 0 days.

(21) Appl. No.: 12/863,967

(22) PCT Filed: Jan. 21, 2009

(86) PCT No.: PCT/EP2009/050669
§ 371 (c)(1),
(2), (4) Date: Dec. 15, 2010

(87) PCT Pub. No.: WO2009/092739
PCT Pub. Date: Jul. 30, 2009

(65) Prior Publication Data

US 2011/0086791 A1 Apr. 14, 2011

(30) Foreign Application Priority Data

Jan. 22, 2008 (EP) ..... 08100756

(51) Int. Cl.
*C11D 7/36* (2006.01)

(52) U.S. Cl.
USPC ..... 510/236; 510/235; 510/276; 510/288; 510/431; 510/436; 510/467

(58) Field of Classification Search
USPC ..... 510/235, 236, 276, 288, 431, 436, 467
See application file for complete search history.

(56) References Cited

U.S. PATENT DOCUMENTS

| | | | | |
|---|---|---|---|---|
| 5,039,441 | A * | 8/1991 | Thomas et al. | 510/238 |
| 5,414,112 | A * | 5/1995 | Dragisich | 562/12 |
| 5,690,174 | A * | 11/1997 | Chapman et al. | 166/275 |
| 2004/0127377 | A1* | 7/2004 | Rodrigues | 510/220 |
| 2005/0239043 | A1* | 10/2005 | Harding | 435/4 |
| 2006/0014655 | A1* | 1/2006 | Smets et al. | 510/101 |
| 2006/0035323 | A2* | 2/2006 | Bisgard Frantzen et al. | 435/69.1 |
| 2007/0015678 | A1 | 1/2007 | Rodrigues et al. | |
| 2007/0179076 | A1* | 8/2007 | Gibson et al. | 510/392 |
| 2008/0234519 | A1* | 9/2008 | Notte et al. | 568/14 |
| 2009/0011972 | A1* | 1/2009 | Suzuki et al. | 510/421 |
| 2009/0093389 | A1* | 4/2009 | Tijanic et al. | 510/161 |
| 2010/0186961 | A1* | 7/2010 | Notte et al. | 166/311 |

FOREIGN PATENT DOCUMENTS

| | | | |
|---|---|---|---|
| EP | 001853 | | 6/1982 |
| EP | 291869 | | 11/1988 |
| EP | 496605 | | 7/1992 |
| EP | 0682105 | A2 | 11/1995 |
| EP | 0713910 | A2 | 5/1996 |
| EP | 0859044 | A1 | 8/1998 |
| EP | 0892039 | A1 | 1/1999 |
| EP | 1035198 | A2 | 9/2000 |
| EP | 1090980 | A1 | 4/2001 |
| WO | WO98/30666 | | 7/1998 |

* cited by examiner

*Primary Examiner* — Charles Boyer
(74) *Attorney, Agent, or Firm* — Samuel Digirolamo; Husch Blackwell LLP

(57) ABSTRACT

Surface treatment compositions containing selected phosphonic acid compounds are disclosed. The compositions contain major levels of surface-active agents in combination with additive levels of the phosphonic acid compounds, and, in accordance with needs and objectives, conventional optional ingredients and additive agents. The inventive compositions can provide significant performance benefits, among others novel synergies and eminently desirable regulatory and environmental acceptability.

11 Claims, No Drawings

SURFACE TREATMENT COMPOSITION CONTAINING PHOSPHONIC ACID COMPOUNDS

CROSS REFERENCE TO RELATED APPLICATIONS

This application is a U.S. National Phase Application of International Application PCT Application No. PCT/EP2009/050669, filed on Jan. 21, 2009, which claims the benefit of priority from European Patent Application No. 08100756.9, filed on Jan. 22, 2008. The disclosures of International Application PCT Application No. PCT/ EP2009/050669 and European Application 08100756.9 are incorporated herein by reference.

This invention relates to surface treatment, in particular cleaning, compositions containing surface-active agents, selected phosphonic acid compounds, and optionally conventional additives and further components, exhibiting desirable properties over a broad range of applications. The surface treatment compositions can be used in known applications including detergent laundry compositions, dishwashing compositions, textile softening compositions and hard surface cleaners. The surface treatment compositions herein comprise as a major constituent, generally of from 99.9% to 40% of a surface-active agent and from 0.1% to 60% of a phosphonic acid compound.

The use of surface cleaning compositions containing surface-active agents in combination with a large variety of individual additives and optional components is widespread and is accordingly acknowledged in the art. This applies, inter alia, to combinations of surfactants and phosphonic acid compounds. Ever more demanding performance criteria and other major parameters including economics, component compatibility and environmental acceptability have created an overriding need for providing novel, different from existing, active ingredients which are eminently suitable for meeting prevailing needs and delivering additional benefits possibly resulting from synergies among the ingredients of the treatment composition.

US 2007/0015678 describes modified polysaccharide polymers, in particular oxidized polymers containing up to 70 mole % carboxyl groups and up to 20 mole % aldehyde groups. The modified polysaccharides can be used in a variety of applications including water treatment. The modified polysaccharides can also be used in blends with other chemicals including conventional phosphonates. EP 1 090 980 discloses fabric rejuvenating technologies including compositions and methods. Phosphonates are used as builders and as metal sequestrants. 2-Phosphonobutane-1,2,4-tricarboxylic acid is preferred in that respect. EP 1 035 198 teaches the use of phosphonates as builders in detergent tablets. Phosphonates are also used in the tablet coating composition.

EP 0 892 039 pertains to liquid cleaning compositions containing a non-ionic surfactant, a polymer, such as a vinyl pyrrolidone homopolymer or copolymer, a polysaccharide, such as a xanthan gum, and an amphoteric surfactant. Conventional phosphonates e.g. diethylene triamino penta(methylene phosphonic acid) (DTPMP) can be used as chelating agents. EP 0 859 044 concerns liquid hard surface cleaners containing dicapped poly alkoxylene glycols capable of conferring soil removal properties to the surface to which the cleaner has been applied. The cleaner compositions can contain phosphonates e.g. DTPMP, to thus provide chelating properties.

Oxygen bleach detergent technology/compositions containing heavy metal sequestrants, such as phosphonobutane tricarboxylic acid, are described in EP 0 713 910. Bleaching machine dishwashing compositions are illustrated in EP 0 682 105. DTPMP is used as heavy metal ion sequestrant.

The art chiefly aims at combining cumulative functionalities to thus yield additive results without providing to any substantial degree, particularly within the context of surface treatment applications broadly, desirable benefits without being subject to incidental (secondary) performance negatives and/or without using multi component systems, which in addition to benefits can be subject to aleatory economic, environmental and/or acceptability shortcomings.

It is a major object of this invention to provide surface treatment technology, in particular compositions, capable of delivering superior performance. It is another object of this invention to provide effective treatment compositions capable of providing significant benefits, at least equivalent or better than the art, with significantly decreased environmental and/or acceptability profiles. Yet another object of this invention aims at generating laundry compositions capable of delivering superior performance with markedly reduced incidental e.g. environmental shortcomings. Yet another object of this invention aims at generating surface treatment technology capable of providing, in addition to the art established functionalities, additional functionalities to thus generate further benefits attached to the structural configuration of specific ingredients in relation to other ingredients in the composition.

The foregoing and other objects of this invention can now be met by the provision of surface treatment compositions broadly comprising surface-active agents and combination with specifically defined amino alkylene phosphonic acid compounds.

The term "percent" or "%" as used throughout this application stands, unless defined differently, for "percent by weight" or "% by weight". The terms "phosphonic acid" and "phosphonate" are also used interchangeably depending, of course, upon medium prevailing alkalinity/acidity conditions. Both terms comprise the free acids, salts and esters of phosphonic acids. The terms "surface active" and "surfactant" are used interchangeably. The term "ppm" means "part per million".

Surface treatment compositions containing surface-active agents, optionally conventional additives and further components, and an amino alkylene phosphonic acid compound have now been discovered. In more detail, the compositions of this invention concern surface treatment compositions comprising:

(a) from 99.9 to 40% by weight (based on the sum of (a) and (b)) of a surface-active agent; and (b) from 0.1 to 60% by weight (based on the sum of (a) and (b)) of a phosphonic acid compound selected from the group of:

(I) aminoacid alkylene phosphonic acids having the formula $$A^1\text{-}(B)_x$$

wherein $A^1$ has the formula $$HOOC\text{-}A\text{-}NH_2$$

wherein A is independently selected from $C_2$-$C_{20}$ linear, branched, cyclic or aromatic hydrocarbon moieties, optionally substituted by $C_1$-$C_{12}$ linear, branched, cyclic or aromatic hydrocarbon groups, optionally substituted by OH, COOH and/or $NH_2$ moieties, and B is an alkylene phosphonic acid moiety having from 1 to 6 carbon atoms in the alkyl group and x is an integer of from 1 to 10;

(II) amino acid alkylene phosphonic acids having the formula $A^2$-$B_y$, wherein $A^2$ has the formula

HOOC—C($NH_2$)(R)(R')

wherein R and R' are independently selected from $C_1$-$C_{20}$ linear, branched, cyclic or aromatic hydrocarbon moieties, optionally substituted by $C_1$-$C_{12}$ linear, branched, cyclic or aromatic hydrocarbons groups, optionally substituted by OH, $NH_2$ and/or COOH, and one of R or R' can be hydrogen, with the proviso of excluding:

compounds wherein R and/or R' are electron rich moieties containing, at least, one lone pair of electrons, which moiety is directly attached to an aromatic moiety by a covalent bond; or aromatics wherein at least one of the carbon atoms has been substituted by a heteroatom; and compounds, in the event R is —C(X)(R")(R'") and R', R" and R'" are hydrogen wherein X is an electron withdrawing group selected from $NO_2$, CN, COOH, $SO_3H$, OH and halogen, and with the further proviso that when:

$A^2$ is L-lysine, at least one L-lysine amino radical carries 2 (two) alkyl phosphonic acid moieties; and when $A^2$ is L-glutamic acid, the term glutamic acid phosphonate represents a combination of from 50-90% by weight pyrrolidone carboxylic acid N-methylene phosphonic acid and from 10-50% by weight of L-glutamic acid diphosphonic acid, expressed on the basis of the reaction products; and B is an alkylene phosphonic acid moiety having from 1 to 6 carbon atoms in the alkyl group and y is an integer in the range of from 1 to 10;

(III) a phosphonate compound of the general formula:

T-B wherein B is a phosphonate containing moiety having the formula:

—X—N(W)($ZPO_3M_2$)

wherein X is selected from $C_2$-$C_{50}$ linear, branched, cyclic or aromatic hydrocarbon moiety, optionally substituted by a $C_1$-$C_{12}$ linear, branched, cyclic, or aromatic group, (which moiety and/or which group can be) optionally substituted by OH, COOH, F, OR' and SR' moieties, wherein R' is a $C_1$-$C_{12}$ linear, branched, cyclic or aromatic hydrocarbon moiety; and $[A\text{-}O]_x$-A wherein A is a $C_2$-$C_9$ linear, branched, cyclic or aromatic hydrocarbon moiety and x is an integer from 1 to 200;

Z is a $C_1$-$C_6$ alkylene chain;

M is selected from H, $C_1$-$C_{20}$ linear, branched, cyclic or aromatic hydrocarbon moieties and from alkali, earth alkali and ammonium ions and from protonated amines;

W is selected from H, $ZPO_3M_2$ and $[V\text{—}N(K)]_nK$, wherein V is selected from: a $C_2$-$C_{50}$ linear, branched, cyclic or aromatic hydrocarbon moiety, optionally substituted by $C_1$-$C_{12}$ linear, branched, cyclic or aromatic groups, (which moieties and/or groups are) optionally substituted by OH, COOH, F, OR' or SR' moieties wherein R' is a $C_1$-$C_{12}$ linear, branched, cyclic or aromatic hydrocarbon moiety; and from $[A\text{-}O]_x$-A wherein A is a $C_2$-$C_9$ linear, branched, cyclic or aromatic hydrocarbon moiety and x is an integer from 1 to 200; and K is $ZPO_3M_2$ or H and n is an integer from 0 to 200;

and wherein T is a moiety selected from the group of:

(i) MOOC—X—N(U)—;

(ii) MOOC—C($X^2$)$_2$—N(U)—;

(iii) MOOC—X—S—;

(iv) $[X(HO)_{n'}(N\text{—}U)_{n''}]_{n'''}$—;

(v) U—N(U)—$[X\text{—}N(U)]_{n''''}$—;

(vi) D-S—;

(vii) CN—;

(viii) MOOC—X—O—;

(ix) MOOC—C($X^2$)$_2$—O—;

(x) NHR"—; and (xi) $(DCO)_2$—N—;

wherein M, Z, W and X are as defined above; U is selected from linear, branched, cyclic or aromatic $C_1$-$C_{12}$ hydrocarbon moieties, H and X—N(W)($ZPO_3M_2$); $X^2$ is independently selected from H, linear, branched, cyclic or aromatic $C_1$-$C_{20}$ hydrocarbon moieties, optionally substituted by $C_1$-$C_{12}$ linear, branched, cyclic or aromatic hydrocarbon groups, optionally substituted by OH, COOH, R'O, R'S and/or $NH_2$ moieties; n', n" and n'" are independently selected from integers of from 1 to 100; D and R" are independently selected from $C_1$-$C_{50}$ linear, branched, cyclic or aromatic hydrocarbon moieties, optionally substituted by a $C_1$-$C_{12}$ linear, branched, cyclic, or aromatic group, (which moiety and/or which group can be) optionally substituted by OH, COOH, F, OR' and SR' moieties, wherein R' is a $C_1$-$C_{12}$ linear, branched, cyclic or aromatic hydrocarbon moiety; and A'O-$[A\text{-}O]_x$-A wherein A is a $C_2$-$C_9$ linear, branched, cyclic or aromatic hydrocarbon moiety, x is an integer from 1 to 200 and A' is selected from $C_1$-$C_{50}$ linear, branched, cyclic or aromatic hydrocarbon moiety, optionally substituted by a $C_1$-$C_{12}$ linear, branched, cyclic, or aromatic group, (which moiety and/or which group can be) optionally substituted by OH, COOH, F, OR' and SR' moieties, wherein R' has the meaning given above; with the further proviso that D can also be represented by H;

(IV) linear or branched hydrocarbon compounds having from 6 to $2.10^6$ carbon atoms containing amino groups substituted by alkylene phosphonic acid substituents and/or —X—N(W)($ZPO_3M_2$), with respect to the hydrocarbon group, in either terminal or branched positions whereby the molar ratio of the aminoalkylene phosphonic acid substituents to the number of carbon atoms in the hydrocarbon chain is in the range of from 2:1 to 1:40 whereby at least 30% of the available NH functionalities have been converted into the corresponding aminoalkylene phosphonic acid and/or into —X—N(W)($ZPO_3M_2$) substituted groups and wherein the alkylene moiety is selected from $C_{1-6}$; and X, W, Z and M have the same meaning as given above; and (V) alkylamino alkylene phosphonate compounds having the formula:

Y—$[X\text{—}N(W)(ZPO_3M_2)]_s$ the structural elements having the following meaning:

X is selected from $C_2$-$C_{50}$ linear, branched, cyclic or aromatic hydrocarbon moieties, optionally substituted by a $C_1$-$C_{12}$ linear, branched, cyclic, or aromatic group, (which moiety and/or which group can be) optionally substituted by OH, COOH, F, OR', $R^2O[A\text{-}O]_x$— wherein $R^2$ is a $C_1$-$C_{50}$ linear, branched, cyclic or aromatic hydrocarbon moiety, and SR' moieties, wherein R' is a $C_1$-$C_{50}$ linear, branched, cyclic or aromatic hydrocarbon moiety, optionally substituted by $C_1$-$C_{12}$ linear, branched, cyclic or aromatic hydrocarbon groups, (said moieties and/or groups can be) optionally substituted by COOH, OH, F, OR' and SR'; and $[A\text{-}O]_x$-A wherein A is a $C_2$-$C_9$ linear, branched, cyclic or aromatic hydrocarbon moiety and x is an integer from 1 to 200;

Z is a $C_1$-$C_6$ alkylene chain;

M is selected from H, $C_1$-$C_{20}$ linear, branched, cyclic or aromatic hydrocarbon moieties and from alkali, earth alkali and ammonium ions and from protonated amines;

W is selected from H, $ZPO_3M_2$ and $[V—N(K)]_nK$, wherein V is selected from: a $C_2$-$C_{50}$ linear, branched, cyclic or aromatic hydrocarbon moiety, optionally substituted by $C_1$-$C_{12}$ linear, branched, cyclic or aromatic groups, (which moieties and/or groups can be) optionally substituted by OH, COOH, F, OR', $R^2O[A\text{-}O]_x$— wherein $R^2$ is a $C_1$-$C_{50}$ linear, branched, cyclic or aromatic hydrocarbon moiety, and SR' moieties; and from $[A\text{-}O]_x$-A wherein A is a $C_2$-$C_9$ linear, branched, cyclic or aromatic hydrocarbon moiety and x is an integer from 1 to 200;

K is $ZPO_3M_2$ or H and n is an integer from 0 to 200; and

Y is a moiety selected from $NH_2$, NHR', $N(R')_2$, NH, N, OH, OR', S, SH, and S—S wherein R' is as defined above with the proviso that when Y is OH or OR', X is, at least, $C_4$; and s is 1 in the event Y stands for $NH_2$, NHR', $N(R')_2$, HS, OR', or OH; s is 2 in the event Y stands for NH, NR', S or S—S; and s is 3 in the event Y stands for N.

Specific α-aminoacids not suitable for use within the claimed (II) phosphonic acids are: tyrosine; tryptophan; asparagine; aspartic acid; and serine. This "non-suitable" proviso is not applicable to the (III) phosphonic acids as e.g. represented by (III) (ii) species.

In the definition of A, R, R', M, V, A', U, $x^2$, D, and R", the $C_x$-$C_y$ linear or branched hydrocarbon moiety is preferably linear or branched alkane-diyl with a respective chain length. Cyclic hydrocarbon moiety is preferably $C_3$-$C_{10}$-cycloalkane-diyl. Aromatic hydrocarbon moiety is preferably $C_6$-$C_{12}$-arene-diyl. When the foregoing hydrocarbon moieties are substituted, it is preferably with linear or branched alkyl of a respective chain length, $C_3$-$C_{10}$-cycloalkyl, or $C_6$-$C_{12}$-aryl. All these groups can be further substituted with the groups listed with the respective symbols.

More and particularly preferred chain lengths for alkane moieties are listed with the specific symbols. A cyclic moiety is more preferred a cyclohexane moiety, in case of cyclohexane-diyl in particular a cyclohexane-1,4-diyl moiety. An aromatic moiety is preferably phenylene or phenyl, as the case may be, for phenylene 1,4-phenylene is particularly preferred.

The compositions of the invention comprise one or more, preferably one to five, phosphonic acid compounds (b).

The compositions of the invention comprise one or more, preferably one to ten, surface active compounds (a).

The treatment compositions can be used, in a conventional manner, for application in relation to all kind of surfaces, in particular for cleaning. The like applications can be represented by: textile laundry; textile softening, textile bleaching; hard surface treatment; household and industrial dishwasher use; glass and other cleaning applications well known in the domain of the technology.

The cleaning compositions comprise, as a major constituent, of from 99.9% to 40% of a surface active agent and from 0.1% to 60% of a selected amino alkylene phosphonic acid compound, these levels being expressed in relation to the sum of the constituents. The cleaning compositions of this invention frequently contain surfactant ingredients in the range of from 2 to 50%, more preferably of from 3 to 40%. The phosphonate ingredient herein can be used, in the actual treatment compositions, in sub additive levels in the range of from 0.0001 to 5%, preferably from 0.001 to 2%. The phosphonate exhibits, within the context of the actual cleaning composition, conventional phosphonate functionalities such as chelant, sequestrant, threshold scale inhibition, dispersant and oxygen bleach analogous properties, but, in addition, can provide, in part due to structural particularities of the essential phosphonate ingredient, additional synergistic functionalities in relation to e.g. optional ingredients, such as aesthetics e.g. perfumes, optical brighteners, dyes, and catalytic enhancers for enzymes, and also to provide improved storage stability to e.g. bactericides thus allow a reformulation of the composition without adversely affecting performance objectives. The essential phosphonate constituent, very importantly, can greatly facilitate the environmental and regulatory acceptability of the cleaning compositions herein.

The cleaning compositions optionally also comprise conventional additives and further components which are used in art established levels and for their known functionalities. The surface active agents herein can be represented by conventional species selected from e.g. cationic, anionic, non-ionic, ampholytic and zwitterionic surfactants and mixtures thereof. Typical examples of the like conventional detergent components are recited. Useful surfactants include $C_{11}$-$C_{12}$ alkyl benzene sulfonates, $C_{10}$-$C_{20}$ alkyl sulfates, $C_{12}$-$C_{20}$ alkyl alkoxy sulfates containing e.g. 1-6 ethoxy groups and $C_{10}$-$C_{20}$ soaps. Suitable non-ionic surfactants can also be represented by amine oxides having the formula R,R',R"N→O wherein R, R' R" can be alkyl having from 10 to 18 carbon atoms. Cationic surfactants include quaternary ammonium surfactants such as $C_{6\text{-}16}$ N-alkyl or alkenyl ammonium surfactants.

Cleaning compositions in general are well known and have found commercial application for a long time. The ingredients of such compositions are eminently well known, including quantitative and qualitative parameters. We wish to exemplify, in a summary manner, some of the matrixes of treatment compositions to which the essential phosphonate ingredient can be added. Solid machine dishwashing composition containing a surfactant selected from cationic, anionic, non-ionic ampholytic and zwitterionic species and mixtures thereof in a level of from 2 to 40%, a builder broadly in a level of from 5 to 60%. Suitable builder species include water-soluble salts of polyphosphates, silicates, carbonates, polycarboxylates e.g. citrates, and sulfates and mixtures thereof and also water-insoluble species such as zeolite type builders. The dishwashing composition can also include a peroxybleach and an activator therefore such as TAED (tetra acetyl ethylene diamine). Conventional additives and optional components including enzymes, proteases and/or lipases and/or amylases, suds regulators, suds suppressors, perfumes, optical brighteners, and possibly coating agents for selected individual ingredients. Such additives and optional ingredients are generally used for their established functionality in art established levels.

The various types of cleaning compositions are generically well known and have found widespread commercial application. Specific examples of individual compositions in accordance with this invention are recited below.

Heavy Duty Liquid Laundry Detergent.

| | Parts by weight. |
|---|---|
| $C_{10\text{-}22}$ fatty acids | 10 |
| Nonionic surfactant | 10 |
| Anionic surfactant | 15 |
| Potassium hydroxide (50%) | 3 |
| 1,2-Propanediol | 5 |
| Sodium citrate | 5 |
| Ethanol | 5 |

-continued

Heavy Duty Liquid Laundry Detergent.

| | Parts by weight. |
|---|---|
| Enzymes | 0.2-2 |
| Phosphonate | 1-3 |
| Minors and water | balance to 100 |

Laundry Detergent Powder.

| | Parts by weight. |
|---|---|
| Zeolite builder | 25 |
| Nonionic surfactant | 10 |
| Anionic surfactant | 10 |
| Calcium carbonate | 10 |
| Sodium meta silicate | 3 |
| Sodium percarbonate | 15 |
| TAED | 3 |
| Optical brightener | 0.2 |
| Polyvinyl pyrrolidone | 1 |
| Carboxymethyl cellulose | 2 |
| Acrylic copolymer | 2 |
| Enzymes | 0.2-2 |
| Perfumes | 0.2-0.4 |
| Phosphonates | 0.1-2 |
| Sodium sulphate | balance to 100 |

Fabric softener.

| | Parts by weight. |
|---|---|
| Phosphoric acid | 1 |
| Distearyl dimethyl ammonium chloride | 10-20 |
| Stearyl amine ethoxylate | 1-3 |
| Magnesium chloride (10%) | 3 |
| Perfume; dye | 0.5 |
| Phosphonate | 0.1-2 |
| Water | balance to 100 |

Automatic dishwashing powder.

| | Parts by weight. |
|---|---|
| Sodium tripolyphosphate | 40 |
| Nonionic surfactant (low foaming) | 3-10 |
| Sodium carbonate | 10 |
| Sodium metasilicate | 3 |
| Sodium percarbonate | 15 |
| TAED | 5 |
| Acrylic copolymer | 2 |
| Zinc sulphate | 0.1-2 |
| Enzymes | 0.2-2 |
| Phosphonate | 0.1-2 |
| Sodium sulphate | balance to 100 |

Hard surface cleaner (Industrial).

| | Parts by weight. |
|---|---|
| Sodium hydroxide (50%) | 40 |
| Low foaming non-ionic surfactant | 5-20 |
| Sodium carbonate | 2-5 |

-continued

Hard surface cleaner (Industrial).

| | Parts by weight. |
|---|---|
| Phosphonate | 0.1-3 |
| Water | balance to 100 |

Multi Purpose Kitchen Cleaner

| | Parts by weight. |
|---|---|
| Low foaming non-ionic surfactant | 2-5 |
| Potassium hydroxide (50%) | 1-3 |
| Fatty $C_{10-20}$ Acid | 2-5 |
| 1,2-Propanediol | 3-5 |
| Sodium metasilicate | 1-2 |
| Phosphonate | 0.1-2 |
| Color and Perfume | 0.1-0.5 |
| Water | balance to 100 |

Bottle Washing.

| | Parts by weight. |
|---|---|
| Low-foaming non-ionic surfactant | 5-15 |
| Phosphoric acid (85%) | 30-40 |
| Isopropanol | 2-5 |
| Phosphonate | 0.5-5 |
| Water | balance to 100 |

In a further aspect of the invention, there is provided the use of a composition as described above for the treatment of surfaces, in particular for textile laundry, textile and industrial textile treatment, such as softening, bleaching and finishing, hard surface treatment specifically cleaning, household and industrial dishwashing applications.

Further provided is a method for treating a surface comprising the step of applying a composition of the invention to that surface.

The essential phosphonic acid compound is selected from the above mentioned groups (I) to (V) of:

(I): amino acid, other than α, alkylene phosphonic acids;

(II): α-amino acid alkylene phosphonic acids;

(III): phosphonate compounds containing an amino alkylene phosphonic acid group, linked to a hydrocarbon chain, attached to a moiety selected from 11 structures;

(IV): hydrocarbon compounds containing amino alkylene phosphonic acid substituents; and (V): amino alkylene phosphonic acids linked to a hydrocarbon compound containing a moiety selected from N, O or S.

Suitable species of preferred amino acid alkylene phosphonic acids (I) are represented by:

7-aminoheptanoic acid;

6-aminohexanoic acid;

5-aminopentanoic acid;

4-aminobutyric acid; and

β-alanine;

whereby x is 2 in each of such species.

The α-amino acid alkylene phosphonic acids (II) can, in preferred embodiments, be selected from:

D,L-alanine wherein y is 2;

L-alanine wherein y is 2;

L-phenylalanine wherein y is 2;

L-lysine wherein y is in the range from 2 to 4;

L-arginine wherein y is in the range from 2 to 6;

L-threonine wherein y is 2;

L-methionine wherein y is 2;

L-cysteine wherein y is 2; and

L-glutamic acid wherein y is 1 to 2.

It was found that the L-glutamic acid alkylene phosphonic acid compound as such is, because of insufficient performance and stability, not suitable for use in the method of this invention. Depending upon the formation reaction conditions, the L-glutamic acid alkylene phosphonic acid resulting from the methylenephosphonation of L-glutamic acid can be represented by a substantially binary mixture containing, based on the mixture (100%), a majority of a mono-methylene phosphonic acid derived from a carboxylic acid substituted pyrrolidone and a relatively smaller level of a dimethylene phosphonic acid glutamic acid compound. It was found that, in one beneficial embodiment the reaction product frequently contains from 50% to 90% of the pyrrolidone carboxylic acid N-methylene phosphonic acid scale inhibitor and from 10% to 50% of the L-glutamic acid bis(alkylene phosphonic acid) compound. The sum of the diphosphonate and monophosphonate inhibitors formed during the reaction frequently exceeds 80%, based on the glutamic acid starting material. The binary mixture can also be prepared by admixing the individual, separately prepared, phosphonic acid compounds. In another preferred execution, the L-lysine carrying one alkylene phosphonic acid group attached to amino radical(s) represents not more than 20 mole % of the sum of the L-lysine carrying one and two alkylene phosphonic acid groups attached to amino radical(s). In another preferred execution, the L-lysine alkylene phosphonic acid is represented by a mixture of L-lysine carrying two alkylene phosphonic acid groups attached to (individual) amino radical(s) (lysine di) and L-lysine carrying four alkylene phosphonic acid groups (lysine tetra) whereby the weight ratio of lysine tetra to lysine di is in the range of from 9:1 to 1:1, even more preferred 7:2 to 4:2.

The phosphonate compound (III) can, in preferred embodiments, be represented by a phosphonate moiety attached to a moiety T of the formula:

$$\text{MOOC—X—N(U)—;} \quad \text{(i)}$$

$$\text{MOOC—C(X}^2\text{)}_2\text{—N(U)—;} \quad \text{(ii)}$$

$$[\text{X(HO)}_{n'}(\text{N—U})_{n'}]_{n''}\text{—;} \quad \text{(iv)}$$

$$\text{U—N(U)—[X—N(U)]}_{n'''}\text{—;} \quad \text{(v)}$$

$$\text{MOOC—X—O—;} \quad \text{(viii)}$$

$$\text{MOOC—C(X}^2\text{)}_2\text{—O—;} \quad \text{(ix)}$$

$$\text{NHR''—; and} \quad \text{(x)}$$

$$\text{(DCO)}_2\text{—N—.} \quad \text{(xi)}$$

The hydrocarbon compounds containing amino alkylene phosphonic acids (IV) are, in preferred embodiments, characterized by a molar ratio of amino alkylene phosphonic acid substituents to carbon atoms in the hydrocarbon group of from 2:1 to 1:8; more preferably of from 2:1 to 1:4. In preferred embodiments, the hydrocarbon group contains from 6 to 500000, more preferably from 6 to 100000 carbon atoms.

The amino alkylene phosphonic acid compounds (V) contain preferably a moiety containing N and/or O atoms broadly substituted or non-substituted, most preferably a moiety selected from NH, N and OH.

M is selected from H, $C_1$-$C_{20}$ linear, branched, cyclic or aromatic hydrocarbon moieties and from alkali, earth alkali and ammonium ions and from protonated amines.

In more detail, the essential phosphonate compound herein can be neutralized, depending upon the degree of alkalinity/acidity required by means of conventional agents including alkali hydroxides, earth alkali hydroxides, ammonia and/or amines. Beneficial amines can be represented by alkyl, dialkyl and tri alkyl amines having e.g. from 1 to 20 carbon atoms in the alkyl group, said groups being in straight and/or branched configuration. Alkanol amines such as ethanol amines, di- and tri-ethanol amines can constitute one preferred class of neutralizing agents. Cyclic alkyl amines, such as cyclohexyl amine and morpholine, polyamines such as 1,2-ethylene diamine, polyethylene imine and polyalkoxy mono- and poly-amines can also be used.

The phosphonic acid compounds for use in the inventive arrangement can be prepared by reacting one or more of the available N—H functions of the amine radical with phosphorous acid and formaldehyde, in the presence of hydrochloric acid, in aqueous medium having a pH of generally less than 4 by heating that reaction mixture, at a temperature of usually greater than 70° C. for a sufficient time to complete the reaction. This kind of reaction is conventional and well-known in the domain of the technology and examples of the novel phosphonate compounds have been synthesized, as described below, via the hydrochloric acid route.

In another approach, the phosphonic acid compounds can be prepared under substantial exclusion of hydrohalogenic acid and corresponding by-products and intermediates. Specifically, the phosphonic acids can be made in presence of not more than 0.4%, preferably less than 2000 ppm, of hydrohalogenic acid, expressed in relation to the phosphorous acid component (100%) by reacting phosphorous acid, an amine and formaldehyde in conventional reactant ratios in the presence of an acid catalyst having a pKa equal or inferior to 3.1, followed by recovering, in a known manner, the phosphonic acid reaction product. The catalyst, which is preferably homogeneously compatible with the reaction medium i.e. no precipitation or phase separation, can be represented by sulphuric acid, sulphurous acid, trifluoro acetic acid, trifluoro methane sulfonic acid, methane sulfonic acid, oxalic acid, malonic acid, p-toluene sulfonic acid, and naphthalene sulfonic acid. In another variation of the homogeneous catalytic method, the phosphonic acid compounds can also be manufactured by substituting the homogeneous catalyst by a heterogeneous, with respect to the reaction medium, Broensted acid catalyst selected from solid acidic metal oxide combinations as such or supported onto a carrier material, a cationic exchange resin comprising aromatic copolymers functionalized so as to graft $SO_3H$ moieties onto the aromatic group and perfluorinated resins carrying carboxylic and/or sulfonic acid groups, and an acid catalyst derived from the interaction of a solid support having a lone pair of electrons onto which is deposited an organic Broensted acid or a compound having a Lewis acid site.

The syntheses of examples of the phosphonic acid compounds of the invention are described in the following examples.

EXAMPLES

Throughout the example section, the following abbreviations are used:

PIBMPA stands for propyl imino bis(methylene phosphonic acid).

EIBMPA stands for ethyl imino bis(methylene phosphonic acid).

(A) Synthesis Examples 165.19 g (1 mole) of L-phenyl alanine are mixed with a solution of 164 g (2 moles) of phosphorous acid in 147.8 g of 37% aqueous hydrochloric acid (1.5 moles) and 250 cc of water. The mixture is heated under stirring to 110° C. 180.5 g of a 36.6% aqueous solution (2.2 moles) of formaldehyde are added over a period of 110 minutes while maintaining the reaction temperature between 106° C. and 107° C. Upon completion of the formaldehyde addition, the reaction mixture is maintained, for an additional 90 minutes, at a temperature of 107° C. to 108° C. $^{31}$P NMR analysis of the crude product showed the presence of 68% of L-phenyl alanine bis(methylene phosphonic acid).

131.17 g (1 mole) of L-isoleucine are mixed with a solution of 164 g (2 moles) of phosphorous acid in 147.8 g of 37% aqueous hydrochloric acid (1.5 moles) and 150 cc of water. The mixture is heated under stirring to 110° C. 180.5 g of a 36.6% aqueous solution of formaldehyde (2.2 moles) are added over a period of 100 minutes while maintaining the reaction temperature at 110° C. Upon completion of the formaldehyde addition, the reaction mixture is maintained at 110° C. for an additional 110 minutes. $^{31}$P NMR analysis of the crude product showed the presence of 69.7% of L-isoleucine bis(methylene phosphonic acid).

131.17 g (1 mole) of D,L-leucine are mixed with a solution of 164 g (2 moles) of phosphorous acid in 147.8 g of aqueous hydrochloric acid (1.5 moles) and 150 cc of water. The mixture is heated, under stirring, to 105° C. 180.5 g of a 36.6% aqueous solution of formaldehyde (2.2 moles) are then added over a period of 100 minutes while maintaining the reaction temperature between 105° C. and 110° C. Upon completion of the formaldehyde addition, the reaction mixture is maintained at 110° C. for an additional 60 minutes. $^{31}$P NMR analysis of the crude product showed the presence of 69.7% of D,L-leucine bis(methylene phosphonic acid).

117.15 g (1 mole) of L-valine are mixed with a solution of 164 g (2 moles) of phosphorous acid in 147.8 g of 37% hydrochloric acid (1.5 moles) and 150 g of water. The mixture is heated, under stirring, to 110° C. 180.5 g of 36.6% aqueous formaldehyde (2.2 moles) are added in 85 minutes while maintaining the reaction temperature at 107° C. Upon completion of the formaldehyde addition, the reaction mixture is maintained at 107° C. for an additional 60 minutes. $^{31}$P NMR analysis of the reaction product, as is, showed the presence of 70.3% of L-valine bis(methylene phosphonic acid).

85 g (1 mole) of 2-pyrrolidone are mixed with a solution of 164 g (2 moles) of phosphorous acid in 118.4 g of 37% hydrochloric acid (1.2 moles) and 100 g of water. The mixture is heated, under stirring, to 100° C. 172.1 g of 36.6% aqueous formaldehyde (2.1 moles) are added over a period of 135 minutes while maintaining the reaction temperature between 100° C. and 114° C. Upon completion of the formaldehyde addition, the reaction mixture is maintained at 110° C. for an additional 90 minutes. $^{31}$P NMR analysis of the reaction product, as is, showed the presence of 91.2% of 4-amino butanoic acid bis(methylene phosphonic acid).

113.1 g (1 mole) of ε-caprolactam are mixed with 164 g (2 moles) of phosphorous acid in 118.4 g of 37% aqueous hydrochloric acid (1.2 moles) and 100 g of water. The mixture is heated, under stirring, to 100° C. 172.1 g of 36.6% aqueous formaldehyde (2.1 moles) are added over a period of 105 minutes while maintaining the reaction temperature between 100° C. and 112° C. Upon completion of the formaldehyde addition, the temperature of the reaction mixture is maintained, for an additional 75 minutes, at a temperature of 110° C. $^{31}$P NMR analysis of the reaction product showed the presence of 89% of 6-amino hexanoic acid bis(methylene phosphonic acid).

92.27 g (0.65 mole) of 2-azacyclononanone are mixed with 106.6 g (1.3 moles) of phosphorous acid in 96.07 g of 37% aqueous hydrochloric acid (0.97 mole) and 65 g of water. The mixture is heated, under stirring, to 100° C. 114 g of 36.6% aqueous formaldehyde (1.39 moles) are then added in 70 minutes while maintaining the reaction temperature between 104° C. to 106° C. Upon completion of the formaldehyde addition, the temperature of the reaction mixture is maintained at 107° C. for an additional 60 minutes. $^{31}$P NMR analysis of the reaction product showed the presence of 84% of 8-amino octanoic acid bis(methylene phosphonic acid).

89 g (1 mole) of L-alanine are mixed with 164 g (2 moles) of phosphorous acid in 147.81 g of 37% aqueous hydrochloric acid (1.5 moles) and 150 g of water. The mixture is heated, under stirring, to 110° C. 180.51 g of 36.6% aqueous formaldehyde (2.2 moles) are then added over a period of 120 minutes while maintaining the temperature of the reaction mixture between 110° C. and 115° C. Upon completion of the formaldehyde addition, the temperature of the reaction mixture is maintained at 106° C. for an additional 60 minutes. $^{31}$P NMR analysis of the reaction product showed the presence of 77.6% of L-alanine bis(methylene phosphonic acid).

Arginine was reacted, in a conventional manner, with phosphorous acid and formaldehyde in the presence of hydrochloric acid. The crude reaction was found to be substantially completely, 72.7%, represented by a bis(alkylene phosphonic acid) derivative. This reaction product was used in the use examples.

91.33 g (0.5 mole) of L-lysine hydrochloride are mixed with 164 g (2 moles) of phosphorous acid in 73.91 g of 37% aqueous hydrochloric acid (0.75 mole) and 120 g of water. The mixture is heated, under stirring, to 105° C. 180.51 g of 36.6% aqueous formaldehyde (2.2 moles) are added over a period of 120 minutes while maintaining the reaction temperature between 106° C. and 109° C. Upon completion of the formaldehyde addition, the temperature of the reaction mixture is maintained at 106° C. for an additional 50 minutes. $^{31}$P NMR analysis of the reaction product showed the presence of 72.2% of L-lysine tetra(methylene phosphonic acid) and about 14% of 2-amino 6-imino bis(methylene phosphonic acid) hexanoic acid. This preparation was used in the use examples under the name "tetraphosphonate".

273.98 g (1.5 moles) of L-lysine hydrochloride are mixed with 369 g (4.5 moles) of phosphorous acid in 221.72 g of 37% aqueous HCl (2.25 moles) and 400 g of water. The mixture is heated with stirring to 106° C. 404.14 g of 36.6% Aqueous formaldehyde (4.95 moles) are added over a period of 180 minutes while maintaining the reaction temperature between 106 and 112° C. Upon completion of the formaldehyde addition, the reaction mixture is heated for an additional 60 minutes at 110° C. $^{31}$P NMR analysis of the crude product shows the presence of 52.1% of L-lysine tetra(methylene phosphonic acid), about 19.7% of 2-amino-6-imino bis(methylene phosphonic acid)hexanoic acid and about 22% of N-Me L-lysine diphosphonate. This composition corresponds to an approximate average of 2 methylene phosphonic acid groups per L-lysine moiety. This preparation was used in the use examples under the name "diphosphonate".

147.13 g (1 mole) of L-glutamic acid are mixed with a solution of 164 g (2 moles) of phosphorous acid in 147.8 g of 37% aqueous HCl (1.5 moles) and 120 ml of water. This mixture is heated, under stirring, to 110° C. 180.5 g of 36.6% Aqueous formaldehyde (2.2 moles) are added over a period of 105 minutes while maintaining the reaction temperature around 110° C. Upon completion of the formaldehyde addition, the temperature of the reaction mixture is maintained at 110° C. for an additional 30 minutes. $^{31}$P NMR analysis of the reaction product shows the presence of 20.1% of L-glutamic acid bis(methylene phosphonic acid) and 51.5% of 2-pyrrolidone-5-carboxylic acid N-methylene phosphonic acid.

173.5 g (1 mole) of 4-aminomethyl 1,8-octane diamine were mixed under stirring with 492 g (6 moles) of phosphorous acid, 413.87 g (4.2 moles) of 37% hydrochloric acid and 200 ml of water. The resulting mixture is heated up to 110° C. 541.52 g of 36.6% aqueous (6.6 moles) formaldehyde were added in 300 minutes while maintaining the reaction temperature around 113° C. Upon completion of the formaldehyde addition, the reaction mixture is heated for an additional 60 minutes at 114° C. $^{31}$PNMR analysis of the crude product shows 93.2% of 4-aminomethyl 1,8-octane diamine hexa(methylene phosphonic acid).

222.67 g (1 mole based on the monomer unit) of a 32.2% w/w polyvinyl formamide (Lupamin 4500 from BASF) were mixed under stirring with 164 g (2 moles) of phosphorous acid, 221.71 g (2.25 moles) of 37% hydrochloric acid and 50 ml of water. The resulting mixture was heated up to 110° C. 168 ml of 36.6% aqueous (2.2 moles) formaldehyde was added in 120 minutes while maintaining the reaction temperature between 108 and 110° C. Upon completion of the formaldehyde addition, the reaction mixture was heated for an additional 60 minutes at 105° C. $^{31}$PNMR analysis of the crude reaction product showed the presence of 60% of polyvinyl amine bis(methylene phosphonic acid) in the reacted product mixture.

"6-Amino hexanoic acid PIBMPA" (Mixture of Mono and Bis Alkylation Product)

Solution 1 is prepared by mixing 22.63 g (0.2 moles) of ϵ-caprolactam with 50 ml of water and 64 g (0.8 moles) of a 50% NaOH solution in water and heated for 3 hours at 100° C. A slurry is prepared by mixing 117.3 g (0.4 moles) of 96% pure 3-chloro propyl imino bis(methylene phosphonic acid) and 150 cc of water. 64 g (0.8 moles) of 50% NaOH solution in water diluted to 150 ml with water are gradually added to this slurry between 5 and 10° C. Solution 2 so obtained is mixed with Solution 1 between 8 and 10° C. At the end of the addition 16 g (0.2 moles) of 50% NaOH solution in water are added before heating the resulting mixture to 105° C. for 6 hours. $^{31}$P NMR analysis of the crude reaction mixture shows 68% molar hexanoic acid 6-imino bis[propyl 3-imino bis (methylene phosphonic acid)]; 15% molar hexanoic acid 6-amino propyl 3-imino bis(methylene phosphonic acid) and 9% molar 3-hydroxypropyl imino bis(methylene phosphonic acid).

"11-Amino undecanoic acid PIBMPA" (Mixture of Mono and Bis Alkylation Product)

Slurry 1 is prepared by mixing at room temperature of 40.26 g (0.2 moles) of 11-amino undecanoic acid with 75 ml of water and 64 g (0.8 moles) of a 50% NaOH solution in water. Slurry 2 is prepared by mixing 117.3 g (0.4 moles) of 96% pure 3-chloro propyl imino bis(methylene phosphonic acid) and 150 cc of water. To this slurry 64 g (0.8 moles) of 50% NaOH solution in water diluted to 150 ml with water are gradually added between 5 and 10° C. Solution 2 so obtained is mixed with Slurry 1 between 8 and 10° C. At the end of this addition 24 g (0.3 moles) of 50% NaOH solution in water are added to the reaction mixture along with 2 g of KI before heating to 90° C. for 6 hours. $^{31}$P NMR analysis of the crude reaction mixture shows 54% molar undecanoic acid 11-imino bis[propyl 3-imino bis (methylene phosphonic acid)] and 16% molar undecanoic acid 11-amino propyl 3-imino bis (methylene phosphonic acid).

"2-(2-amino ethoxy)ethanol PIBMPA" (Mixture of Mono and Bis Alkylation Product)

Solution 1 is prepared by mixing at room temperature 21.03 g (0.2 moles) of 2-(2-amino ethoxy)ethanol with 75 ml of water and 80 g (1 mole) of a 50% NaOH solution in water. Slurry 1 is prepared by mixing 117.3 g (0.4 moles) of 96% pure 3-chloro propyl imino bis(methylene phosphonic acid) and 150 cc of water. To this slurry 48 g (0.6 moles) of 50% NaOH solution in water diluted to with water 120 ml are gradually added between 5 and 10° C. Solution 2 so obtained is mixed with Solution 1 between 8 and 10° C. At the end of this addition 16 g (0.2 moles) of 50% NaOH solution in water are added and the resulting mixture heated to 90° C. for 5 hours. $^{31}$P NMR analysis of the crude reaction mixture shows 55% molar 2-(2-imino ethoxy)ethanol bis[propyl 3-imino bis(methylene phosphonic acid)]; 19% molar 2-(2-amino ethoxy)ethanol propyl 3-imino bis (methylene phosphonic acid) and 16% molar of the corresponding azetidinium salt.

"Glycine PIBMPA" (Mixture of Mono and Bis Alkylation Product)

Solution 1 is prepared by mixing at room temperature 15.02 g (0.2 moles) of glycine with 75 ml of water and 96 g (1.2 moles) of a 50% NaOH solution in water. Slurry 1 is prepared by mixing 117.3 g (0.4 moles) of 96% pure 3-chloro propyl imino bis(methylene phosphonic acid) and 150 cc of water. To this slurry 48 g (0.6 moles) of 50% NaOH solution in water diluted to 100 ml with water are gradually added between 5 and 10° C. Solution 2 so obtained is mixed with Solution 1 between 5 and 10° C. At the end of this addition 8 g (0.1 moles) of 50% NaOH solution in water are added to the mixture which is heated to 105° C. for 5 hours. $^{31}$P NMR analysis of the crude reaction mixture shows 67.4% w/w glycine bis[propyl 3-imino bis (methylene phosphonic acid)]; 2.2% w/w glycine propyl 3-imino bis(methylene phosphonic acid) and 3% w/w of the corresponding azetidinium salt.

"Imino Bis (EIBMPA)" (Mixture of Mono and Bis Alkylation Product)

Solution 1 is prepared by mixing between 5 and 8° C. 111.4 g (0.4 moles) of 96% pure 2-chloro ethyl imino bis(methylene phosphonic acid); 300 ml of water and 30 g (0.375 moles) of a 50% NaOH solution in water. Solution 2 is prepared by mixing 130 g (1.625 moles) of 50% aqueous sodium hydroxide with water to get a final volume of 250 ml. Ammonia solution is prepared by mixing 13.6 g (0.8 moles) of 25% ammonia solution in water with 200 ml of water. Solutions 1 and 2 are gradually added to the ammonia solution with good stirring between 8 and 12° C. This mixture is heated to 80° C. for 5 hours. $^{31}$P NMR analysis of the crude reaction mixture shows 56.2% w/w imino bis[ethyl 2-imino bis(methylene phosphonic acid)]; 22.2% w/w amino ethyl 2-imino bis(methylene phosphonic acid) and 11.8% w/w of the nitrilo tris [ethyl 2-imino bis(methylene phosphonic acid)].

"Glycine EIBMPA" (Mixture of Mono and Bis Alkylation Product)

A glycine solution is prepared by mixing at room temperature 7.51 g (0.1 moles) of glycine with 30 ml of water and 8 g (0.1 moles) of a 50% NaOH solution in water. Slurry 1 is prepared by mixing 55.72 g (0.2 moles) of 96% pure 2-chloro ethyl imino bis(methylene phosphonic acid) and 150 cc of water. To this slurry 15 g (0.1875 moles) of 50% NaOH solution in water diluted to 100 ml with water are gradually added between 5 and 10° C. Solution 1 is prepared by diluting 53 g (0.6625 moles) of 50% NaOH in water to a total volume of 110 ml. Solution 1 and slurry 1 are gradually added under stirring to the glycine solution between 8 and 12° C. At the end of this addition 4 g (0.25 moles) of 50% NaOH solution in water are added to the mixture which is heated to 100° C. for 5 hours. $^{31}P$ NMR analysis of the crude reaction mixture shows 74.5% w/w glycine bis [ethyl 2-imino bis(methylene phosphonic acid)]; 7.1% w/w glycine ethyl 2-imino bis(methylene phosphonic acid) and 4.8% w/w of the 2-hydroxy ethyl imino bis(methylene phosphonic acid).

The benefits attached to the compositions in accordance with this invention can be illustrated, directly and/or indirectly, by means of specific testing procedures some of which are shown in the following use examples.

Use Examples

The clay dispersion effectiveness is a significant parameter in many surface treatments such as textile cleaning. This property is demonstrated with the aid of the following testing procedure.

Clay Dispersion.

This test is used to determine and compare the effectiveness of the phosphonate agents of this invention.

A one liter 0.15% w/w solution of the selected phosphonate is prepared in tap water. The solution pH is brought to 11.5 by addition of a 50% sodium hydroxide aqueous solution. Kaolin (1 g) is added and the liquid is agitated, at ambient temperature, till an homogeneous suspension is obtained. The suspension is then introduced in an Imhoff cone. Gradually a second phase appears at the bottom of the cone and its level is recorded at regular intervals (5, 15, 30, 60 and 120 minutes). The aspect and color of the two phases were also recorded at the same intervals. The percentage of dispersion provided by the tested product after 120 minutes is calculated as follows by reference to a blank test which does not contain a phosphonate.

% Dispersion=100−(level of the bottom phase (in ml)×100/level of the bottom phase in the blank (in ml)).

Calcium Tolerance.

This test is used to measure and compare the calcium tolerance of phosphonate compounds. The calcium tolerance is an indirect (qualifying) parameter for using selected phosphonate compounds in the presence of major levels of water hardness e.g. calcium and magnesium.

A solution of the tested product is prepared in 1200 ml of water so as to correspond to a 15 ppm active acid solution in 1320 ml. The solution is heated to 60° C. and its pH adjusted to 10 by addition of a 50% sodium hydroxide solution. Turbidity is measured with a Hach spectrophotometer, model DR 2000, manufactured by Hach Company, P.O. Box 389, Loveland, Colo. 80539, USA and reported in FTU (*) units. Calcium concentration in the tested solution is gradually increased by increments of 200 ppm calcium based on the tested solution. After each calcium addition the pH is adjusted to 10 by addition of a 50% sodium hydroxide solution and turbidity is measured 10 minutes after the calcium addition. A total of 6 calcium solution additions are done.

(*) FTU=Formazin Turbidity Units.

Stain Removal

This test is used to determine and compare the stain removal performance of selected detergent formulations.

A typical base detergent formulation is prepared by mixing together 12 g of $C_{13}$-$C_{15}$ oxo alcohol ethoxylated with 8 moles of ethylene oxide, 10 g of $C_8$-$C_{18}$ coco fatty acid, 6 g of triethanolamine, 4 g of 1,2 propanediol, 15 g of $C_{10}$-$C_{13}$ linear alkylbenzene sulfonate sodium salt, 3 g of ethanol and 50 g water. The first four ingredients are added in the indicated order and heated at 50° C. until a uniform liquid is obtained before adding the other ingredients.

The stain removal testing is conducted at 40° C. in a tergotometer using one liter city water per wash to which are added 5 g of the base detergent formulation and 50 ppm as active acid of the tested phosphonate. Soil coupons are added to the liquid which is agitated at 100 rpm during 30 minutes. After the washing cycle, the swatches are rinsed with city water and dried in the oven for 20 minutes at 50° C. The whiteness of the swatches is measured with the Elrepho 2000, made by Datacolor of Dietlikon, Switzerland. The equipment is standardized, in a conventional manner, with black and white standards prior to the measurement of the washed swatches. The Rz chromatic value is recorded for each swatch before and after the wash cycle. The percentage stain removal for a specific stain and formulation is calculated as follows:

$$\%\ \text{stain removal}\ \frac{(Rz_w - Rz_i)}{(100 - Rz_i)} \times 100$$

with $Rz_w$=the Rz value for the washed swatch $Rz_i$=the Rz value for the unwashed swatch.

Calcium Carbonate Scale Inhibition Procedure

These methods are used to compare the relative ability of selected phosphonates to inhibit calcium carbonate scale formation in e.g. laundry applications.

The following solutions are prepared:

pH buffer: A 10% solution of $NH_4Cl$ in deionized water is adjusted to pH 9.5 with 25% $NH_4OH$ aqueous solution.

pH buffer: A 10% solution of $NH_4Cl$ in deionized water is adjusted to pH 10.0 with 25% $NH_4OH$ aqueous solution.

Inhibitor mother solution 1: An "as is" 1% solution of each inhibitor is prepared. These solutions contain 10,000 ppm inhibitor "as is".

Inhibitor mother solution 2: An "as is" 10% solution of each inhibitor is prepared. These solutions contain 100,000 ppm of inhibitor "as is".

Inhibitor testing solution 1: Weigh accurately 1 g of inhibitor mother solution 1 into a 100 ml glass bottle and adjust to 100 g with deionized water. These solutions contain 100 ppm of inhibitor "as is".

Inhibitor testing solution 2: Weigh accurately 1 g of inhibitor mother solution 2 into a 100 ml glass bottle and adjust to 100 g with deionized water. These solutions contain 100 ppm of inhibitor "as is".

2N sodium hydroxide solution.

The test is carried out as follows:

In a 250 ml glass bottle are placed 75 g of 38° French hardness water; appropriate levels of the inhibitor mother or testing solutions corresponding to 0, 5, 10, 20, 50, 200, 500, 1000, 2500 and 5000 ppm of "as is" inhibitor and 5 ml of the pH 9.5 buffer solution. The pH of the mixture is adjusted to 10, 11 or 12 by addition of 2N sodium hydroxide and appropriate amount of deionized water is added to adjust the total liquid weight to 100 g solution.

The bottle is immediately capped and placed in a shaker controlled at 50° C. for 20 hours. After 20 hours the bottles are removed from the shaker and about 50 ml of the hot solution are filtered using a syringe fitted with a 0.45 micron filter. This filtrate is diluted with 80 ml of deionized water and stabilized with 1 ml of the pH 10 buffer solution.

Calcium in solution is titrated using a 0.01M EDTA solution and a calcium selective electrode combined with a calomel electrode.

Performance of the inhibitor is calculated as follows:

$$\% \text{ Scale inhibition} = \frac{V_1 - V_O}{V_2 - V_O}$$

where: Vo is the volume of EDTA solution needed for the blank $V_2$ is the volume of the EDTA solution needed for 100% inhibition and is determined by titrating a solution containing 10 ml of the inhibitor mother solution 2 diluted with deionized water to 100 g total weight.

$V_1$ is the volume of EDTA solution needed for the test sample.

The peroxide stabilization is tested as follows.

Peroxide Stabilization Procedure

In a 250 ml glass bottle filled with 200 ml deionised water stabilized at 40° C. add the following ingredients: 0.4 g of iron, 35 ppm of the tested bleach stabilizer, 0.53 g of sodium bicarbonate, 0.42 g of sodium carbonate, 0.14 g of sodium perborate tetrahydrate and 0.06 g of tetra-acetyl ethylene diamine (TAED). Dissolve these ingredients in the water by using an ultrasonic bath. After one minute of such treatment the bottle is transferred to the water bath set at 40° C. and samples (10 ml each) are taken from the test bottle 2, 6, 10, 15, 20 and 30 minutes thereafter. To these samples are added 10 ml of 1M potassium iodide and 10 ml of 20% aqueous sulphuric acid before immediate titration with a standardized 0.01N thiosulphate solution.

The testing results were as follows.

Clay Dispersion.

| Time | Blank test ml | | L-Lysine-ph. ml | | D,L-Alanine-ph. ml | |
|---|---|---|---|---|---|---|
| (min) | (1) | (2) | (1) | (2) | (1) | (2) |
| 5 | 5.5 white yellow | clear | 0.1 white yellow | cloudy | 0.2 white yellow | cloudy |
| 15 | 5.5 white yellow | clear | 0.2 white yellow | cloudy | 0.4 white yellow | cloudy |
| 30 | 5.5 white yellow | clear | 0.3 white yellow | cloudy | 0.6 white yellow | cloudy |
| 60 | 5 white yellow | clear | 0.5 white yellow | cloudy | 0.9 white yellow | cloudy |
| 120 | 5 white yellow | clear | 0.8 white yellow | cloudy | 1.1 white yellow | cloudy |
| % Dispersion | 0.0 | | 84.0 | | 78.0 | |

| Time | Hexanoic-ph. ml | | Triamin-ph. ml | |
|---|---|---|---|---|
| (min) | (1) | (2) | (1) | (2) |
| 5 | 0.3 white yellow | cloudy | 0.2 white yellow | cloudy |
| 15 | 0.5 white yellow | cloudy | 0.4 white yellow | cloudy |
| 30 | 0.7 white yellow | cloudy | 0.5 white yellow | cloudy |
| 60 | 0.9 white yellow | cloudy | 0.9 white yellow | cloudy |

-continued

Clay Dispersion.

| | | | | |
|---|---|---|---|---|
| 120 | 1 white yellow | cloudy | 1 white yellow | cloudy |
| % Dispersion | 80.0 | | 83.3 | |

(1) = bottom phase;

(2) = upper phase;

L-Lysine-ph. = L-lysine tetra(methylene phosphonic acid);

D,L-Alanine-ph. = D,L-alanine bis(methylene phosphonic acid);

Hexanoic-ph. = Hexanoic acid 6-imino bis(methylene phosphonic acid);

Triamin-ph. = Triaminononane hexa(methylene phosphonic acid).

Clay dispersion

| Time | Blank test ml | | 6-Amino hexanoic acid PIBMPA ml | | Glycine PIBMPA ml | |
|---|---|---|---|---|---|---|
| (Min) | (1) | (2) | (1) | (2) | (1) | (2) |
| 5 | 6 | cloudy | 0.15 | cloudy | 0.4 | cloudy |
| 15 | 7 | cloudy | 0.4 | cloudy | 0.6 | cloudy |
| 30 | 6 | cloudy | 0.55 | cloudy | 0.9 | cloudy |
| 60 | 6 | clear | 0.8 | cloudy | 1.1 | cloudy |
| 120 | 6 | clear | 1 | cloudy | 1.2 | cloudy |
| % Dispersion | 0.0 | | 82 | | 78 | |

| Time | Blank test ml | | Glycine EIBMPA ml | | 2-(2-Amino ethoxy) ethanol PIBMPA ml | |
|---|---|---|---|---|---|---|
| (Min) | (1) | (2) | (1) | (2) | (1) | (2) |
| 5 | 6 | cloudy | 0.2 | cloudy | 0.5 | cloudy |
| 15 | 7 | cloudy | 0.5 | cloudy | 0.75 | cloudy |
| 30 | 6 | cloudy | 0.7 | cloudy | 1.0 | cloudy |
| 60 | 6 | clear | 1.0 | cloudy | 1.0 | cloudy |
| 120 | 6 | clear | 1.2 | cloudy | 1.4 | cloudy |
| % Dispersion | 0.0 | | 78 | | 74 | |

| Time | Blank test ml | | Imino bis ml | | (EIBMPA) 11-Amino undecanoic acid PIBMPA ml | |
|---|---|---|---|---|---|---|
| (Min) | (1) | (2) | (1) | (2) | (1) | (2) |
| 5 | 6 | cloudy | 0.2 | cloudy | 0.4 | cloudy |
| 15 | 7 | cloudy | 0.3 | cloudy | 0.7 | cloudy |
| 30 | 6 | cloudy | 0.5 | cloudy | 1.0 | cloudy |
| 60 | 6 | clear | 0.7 | cloudy | 1.2 | cloudy |
| 120 | 6 | clear | 0.9 | cloudy | 1.3 | cloudy |
| % Dispersion | 0.0 | | 80 | | 71 | |

Calcium Carbonate Scale Inhibition.

L-Lysine tetra(methylene phosphonic acid)

| Phosphonate addition | Calcium carbonate scale inhibition % at | | |
|---|---|---|---|
| level ppm as is | pH 10 | pH 11 | pH 12 |
| 0 | 17.63 | 2 | 1.7 |
| 5 | 100 | 24 | 14 |

-continued

L-Lysine tetra(methylene phosphonic acid)

| Phosphonate addition | Calcium carbonate scale inhibition % at | | |
|---|---|---|---|
| level ppm as is | pH 10 | pH 11 | pH 12 |
| 10 | 100 | 57 | 30 |
| 20 | 74 | 75 | 45 |
| 50 | 72 | 86 | 55 |
| 200 | 66 | 68 | 47 |
| 500 | 49 | 59 | 49 |
| 1000 | 86 | 63 | 96 |
| 2500 | 97 | 98 | 95 |
| 5000 | 100 | 99 | 91 |

Hexanoic acid 6-imino bis(methylene phosphonic acid)

| Phosphonate addition | Calcium carbonate scale inhibition % at | | |
|---|---|---|---|
| level ppm as is | pH 10 | pH 11 | pH 12 |
| 0 | 6.26 | 1.46 | 1.43 |
| 5 | 37.57 | 2.09 | 1.43 |
| 10 | 33.46 | 2.16 | 1.46 |
| 20 | 39.83 | 1.74 | 1.77 |
| 50 | 73.36 | 3.10 | 5.11 |
| 200 | 100.00 | 13.60 | 13.81 |
| 500 | 80.77 | 86.54 | 80.80 |
| 1000 | 100.00 | 88.31 | 81.36 |
| 2500 | 100.00 | 92.17 | 82.05 |
| 5000 | 100.00 | 99.20 | 83.55 |

D,L-Alanine bis(methylene phosphonic acid)

| Phosphonate addition | Calcium carbonate scale inhibition % at | | |
|---|---|---|---|
| level ppm as is | pH 10 | pH 11 | pH 12 |
| 0 | 28.40 | 2.00 | 1.70 |
| 5 | 66.80 | 4.30 | 3.00 |
| 10 | 96.20 | 3.00 | 3.20 |
| 20 | 97.80 | 6.00 | 10.50 |
| 50 | 95.30 | 82.30 | 36.30 |
| 200 | 100.00 | 76.80 | 76.10 |
| 500 | 95.40 | 80.00 | 76.4 |
| 1000 | 98.00 | 94.80 | 72.70 |
| 2500 | 96.00 | 91.00 | 85.50 |
| 5000 | 71.00 | 96.00 | 90.40 |

Triaminononane hexa(methylene phosphonic acid)

| Phosphonate addition | Calcium carbonate scale inhibition % at | | |
|---|---|---|---|
| level ppm as is | pH 10 | pH 11 | pH 12 |
| 0 | 57.00 | 17.00 | 2.00 |
| 5 | 96.00 | 8.00 | 9.00 |
| 10 | 100.00 | 10.00 | 11.00 |

-continued

Triaminononane hexa(methylene phosphonic acid)

| Phosphonate addition | Calcium carbonate scale inhibition % at | | |
|---|---|---|---|
| level ppm as is | pH 10 | pH 11 | pH 12 |
| 20 | 93.00 | 57.00 | 20.00 |
| 50 | 92.00 | 79.00 | 34.00 |
| 200 | 89.00 | 67.00 | 51.00 |
| 500 | 83.00 | 55.00 | 27.00 |
| 1000 | 70.00 | 37.00 | 61.00 |
| 2500 | 75.00 | 82.00 | 80.00 |
| 5000 | 85.00 | 82.00 | 80.00 |

Example II

| | |
|---|---|
| 1. 2-aminoethoxy ethanol PIBMPA | 2 ppm full scale |
| 2. 11-amino undecanoic acid PIBMPA | 2 ppm full scale |
| 3. Glycine PIBMPA | 2 ppm full scale |
| 4. 6-Amino hexanoic | 2 ppm |

Ca tolerance in deionized water at 60° C. and pH 10

| Tested products at 15 ppm active acid in 1320 ml | $Ca^{+2}$ added (ppm) | Turbidity (FTU) | Appearance upon addition |
|---|---|---|---|
| Triaminononane hexa(methylene phosphonic acid) | 0 | 0 | clear |
| | 200 | 8 | sl. cloudy |
| | 400 | 8 | sl. cloudy |
| | 600 | 8 | sl. cloudy |
| | 800 | 9 | sl. cloudy |
| | 1000 | 7 | sl. cloudy |
| | 1200 | 7 | sl. cloudy |
| L-Lysine tetra(methylene phosphonic acid) | 0 | 0 | clear |
| | 200 | 9 | sl. cloudy |
| | 400 | 10 | sl. cloudy |
| | 600 | 10 | sl. cloudy |
| | 800 | 10 | sl. cloudy |
| | 1000 | 10 | sl. cloudy |
| | 1200 | 10 | sl. cloudy |
| D,L-Alanine bis(methylene phosphonic acid) | 0 | 0 | clear |
| | 200 | 0 | clear |
| | 400 | 0 | clear |
| | 600 | 0 | clear |
| | 800 | 0 | clear |
| | 1000 | 0 | clear |
| | 1200 | 0 | clear |
| Hexanoic acid 6-imino bis(methylene phosphonic acid) | 0 | 0 | clear |
| | 200 | 0 | clear |
| | 600 | 0 | clear |
| | 800 | 0 | clear |
| | 1000 | 0 | clear |
| | 1200 | 0 | clear |

| Stain removal properties | | | | | |
|---|---|---|---|---|---|
| | % stain removal with test stains (*) | | | | |
| Base detergent | Tea 10020 | Oil 10050 | Clay 10055 | Grass EMPA 164 | Wine 10031 |
| Base detergent blank | 26.3 | 44.2 | 51.3 | 14.5 | 51 |
| +50 ppm L-lysine-ph | 37.6 | 58 | 52.5 | 14.9 | 54.2 |
| +50 ppm Hexanoic-ph. | 30.2 | 44.1 | 51 | 12.9 | 53 |
| +50 ppm D,L-Alanine-ph. | 32 | 47 | 53.6 | 14.7 | 54.2 |
| +50 ppm Triamine-ph. | 29.5 | 46.6 | 46 | 16 | 51.7 |

(*) All test swatches are "WFK" except the "EMPA 164".

Additional testing results are as follows.

Calcium Carbonate Scale Inhibition

| 6-Amino hexanoic acid PIBMPA | | | |
|---|---|---|---|
| Phosphonate addition level | Calcium carbonate scale inhibition % | | |
| ppm as is | At pH 10 | pH 11 | pH 12 |
| 0 | 6.9 | 6.75 | 5.7 |
| 1 | 49.3 | 6.0 | 11.3 |
| 5 | 63.9 | 6.5 | 11.4 |
| 10 | 100 | 10 | 11.4 |
| 20 | 100 | 26.1 | 25.9 |
| 50 | 100 | 63.4 | 46.9 |
| 200 | 100 | 86.6 | 67.6 |
| 500 | 100 | 100 | 61.7 |
| 1000 | 100 | 100 | 99 |
| 2500 | 100 | 100 | 100 |
| 5000 | 100 | 100 | 97.3 |

| Glycine PIBMPA | | | |
|---|---|---|---|
| Phosphonate addition level | Calcium carbonate scale inhibition % | | |
| ppm as is | At pH 10 | pH 11 | pH 12 |
| 0 | 4.9 | 6.2 | 2.0 |
| 1 | 36.3 | 2.8 | 4.2 |
| 5 | 63.9 | 1.4 | 1.4 |
| 10 | 95.3 | 15.4 | 17.4 |
| 20 | 96 | 27.3 | 23.8 |
| 50 | 98.6 | 83.3 | 51.4 |
| 200 | 98.8 | 78.4 | 60.6 |
| 500 | 91.3 | 74 | 52.2 |
| 1000 | 84.3 | 96 | 96.1 |
| 2500 | 82.5 | 96.8 | 90.4 |
| 5000 | 92.3 | 95.3 | 81.5 |

| Imino bis (EIBMPA) | | | |
|---|---|---|---|
| Phosphonate addition level | Calcium carbonate scale inhibition % | | |
| ppm as is | At pH 10 | pH 11 | pH 12 |
| 0 | 8.8 | 2.0 | 1.8 |
| 1 | 13.9 | 1.8 | 1.7 |
| 5 | 78.3 | 4.4 | 17.1 |
| 10 | 70.8 | 3.7 | 16.6 |
| 20 | 100 | 25.6 | 16.9 |
| 50 | 100 | 61.3 | 52.7 |
| 200 | 87.1 | 90.6 | 61.2 |
| 500 | 71.4 | 84.4 | 52.7 |
| 1000 | 75.5 | 84.1 | 75.7 |
| 2500 | 91.3 | 63.5 | 71.9 |
| 5000 | 82.4 | 91.6 | 62.0 |

| 2-(2-Amino ethoxy) ethanol PIBMPA | | | |
|---|---|---|---|
| Phosphonate addition level | Calcium carbonate scale inhibition % | | |
| ppm as is | At pH 10 | pH 11 | pH 12 |
| 0 | 53.1 | 7.9 | 9.9 |
| 1 | 53.6 | 2.8 | 3.0 |
| 5 | 54.5 | 14.5 | 11.6 |
| 10 | 100 | 7.4 | 12.9 |
| 20 | 100 | 16.0 | 34.4 |
| 50 | 100 | 17.2 | 34.3 |
| 200 | 100 | 97.6 | 31.9 |
| 500 | 100 | 88.1 | 65.5 |
| 1000 | 100 | 97 | 86.8 |
| 2500 | 100 | 100 | 100 |
| 5000 | 100 | 100 | 100 |

| 11-Amino undecanoic acid PIBMPA | | | |
|---|---|---|---|
| Phosphonate addition level | Calcium carbonate scale inhibition % | | |
| ppm as is | At pH 10 | pH 11 | pH 12 |
| 0 | 40.7 | 1.7 | 2.0 |
| 1 | 55.1 | 2.1 | 2.1 |
| 5 | 66.7 | 5.9 | 8.7 |
| 10 | 100 | 8.6 | 11.3 |
| 20 | 100 | 18.9 | 15.9 |
| 50 | 100 | 47.6 | 39.8 |
| 200 | 100 | 62.8 | 51.5 |
| 500 | 90.8 | 70.0 | 59.6 |
| 1000 | 78.1 | 56.0 | 46.7 |
| 2500 | 57.1 | 84.0 | 30.4 |
| 5000 | 82.7 | 44.5 | 84.0 |

Stain Removal Properties

| | % Stain removal with test stains | | | | |
|---|---|---|---|---|---|
| Base Detergent | Tea | Oil | Clay | Grass | Wine |
| Base detergent blank | 14.7 | 30.2 | 47.1 | 11.1 | 51.8 |
| +100 ppm Dequest 2016 | 28.9 | 32.7 | 47.8 | 13.2 | 57.0 |

-continued

| Base Detergent | % Stain removal with test stains | | | | |
|---|---|---|---|---|---|
| | Tea | Oil | Clay | Grass | Wine |
| +100 ppm Dequest 2066 | 22.0 | 31.7 | 47.2 | 12.8 | 56.4 |
| +100 ppm 6-amino hexanoic acid PIBMPA | 18.9 | 36.2 | 49.8 | 12.7 | 56.0 |
| +100 ppm Glycine PIBMPA | 21.5 | 33.8 | 46.8 | 14.1 | 56.4 |
| +100 ppm Imino bis(EIBMPA) | 21.1 | 30.2 | 45.9 | 13.3 | 58.1 |
| +100 ppm 2-(2-aminoethoxy) ethanol PIBMPA | 19.1 | 35.0 | 48.3 | 13.0 | 54.5 |
| +100 ppm 11-amino undecanoic acid PIBMPA | 19.7 | 32.1 | 50.3 | 12.5 | 54.3 |

Peroxide Stabilization Properties.

| Tested phosphonate | Time (min) | % remaining active oxygen |
|---|---|---|
| None | 0 | 100 |
| | 2 | 92 |
| | 6 | 80 |
| | 10 | 71 |
| | 15 | 61 |
| | 20 | 53 |
| | 30 | 43 |
| +35 ppmDequest 2066 | 0 | 100 |
| | 2 | 100 |
| | 6 | 99 |
| | 10 | 97 |
| | 15 | 95 |
| | 20 | 94 |
| | 30 | 90 |
| +45.5 ppm 6-amino hexanoic acid PIBMPA | 0 | 100 |
| | 2 | 88 |
| | 6 | 83 |
| | 10 | 79 |
| | 15 | 73 |
| | 20 | 71 |
| | 30 | 67 |
| +35 ppm Imino bis(EIBMPA) | 0 | 100 |
| | 2 | 100 |
| | 6 | 93 |
| | 10 | 91 |
| | 15 | 91 |
| | 20 | 90 |
| | 30 | 89 |
| +17.5 ppm Imino bis(EIBMPA) | 0 | 100 |
| | 2 | 100 |
| | 6 | 97 |
| | 10 | 96 |
| | 15 | 96 |
| | 20 | 94 |
| | 30 | 94 |
| +35 ppm Glycine EIBMPA | 0 | 100 |
| | 2 | 99 |
| | 6 | 98 |
| | 10 | 96 |
| | 15 | 92 |
| | 20 | 89 |
| | 30 | 86 |

What is claimed is:

1. A surface treatment composition comprising a surface-active agent, and optionally further components and additives, characterized in that the composition comprises:

(a) from 99.9 to 40% by weight (based on the sum of (a) and (b)) of a surface-active agent; and (b) from 0.1 to 60% by weight (based on the sum of (a) and (b)) of a phosphonic acid compound selected from the group of:

(I) aminoacid alkylene phosphonic acids having the formula $A^1\text{-}(B)_x$ wherein $A^1$ has the formula

HOOC-A-NH2 wherein A is independently selected from $C_2$-$C_{20}$ linear, branched, cyclic or aromatic hydrocarbon moieties, optionally substituted by $C_1$-$C_{12}$ linear, branched, cyclic or aromatic hydrocarbon groups, optionally substituted by OH and/or COOH moieties, and B is an alkylene phosphonic acid moiety having from 1 to 6 carbon atoms in the alkyl group and x is an integer of from 1 to 10;

(II) aminoacid alkylene phosphonic acids having the formula $A^2\text{-}B_y$ wherein $A^2$ has the formula $HOOC—C(NH_2)(R)(R')$ wherein R and R' are independently selected from $C_1$-$C_{20}$ linear, branched, cyclic or aromatic hydrocarbon moieties, optionally substituted by $C_1$-$C_{12}$ linear, branched, cyclic or aromatic hydrocarbons groups, optionally substituted by OH, $NH_2$ and/or COOH, and one of R or R' can be hydrogen, with the proviso of excluding:

compounds wherein R and/or R' are electron rich moieties containing, at least, one lone pair of electrons, which moiety is directly attached to an aromatic moiety by a covalent bond; or aromatics wherein at least one of the carbon atoms has been substituted by a heteroatom; and compounds, in the event R is —C(X)(R")(R"') and R', R" and R"' are hydrogen where in X is an electron withdrawing group selected from $NO_2$, CN, COOH, SO3H, OH and halogen, and with the further proviso that when:

$A^2$ is L-lysine, at least one L-lysine amino radical carries 2 (two) alkylene phosphonic acid moieties; and when $A^2$ is L-glutamic acid, the term glutamic acid phosphonate represents a combination of from 50-90% by weight pyrrolidone carboxylic acid N-methylene phosphonic acid and from 10-50% by weight of L-glutamic acid diphosphonic acid, expressed on the basis of the reaction products; and B is an alkylene phosphonic acid moiety having from 1 to 6 carbon atoms in the alkyl group and y is an integer in the range of from 1 to 10;

(III) a phosphonate compound of the general formula:

T-B wherein B is a phosphonate containing moiety having the formula:

$—X—N(W)(ZPO_3M_2)$ wherein X is selected from $C_2$-$C_{50}$ linear, branched, cyclic or aromatic hydrocarbon moiety, optionally substituted by a $C_1$-$C_{12}$ linear, branched, cyclic, or aromatic group, (which moiety and/or which group can be) optionally substituted by OH, COOH, F, OR' and SR' moieties, wherein R' is a $C_1$-$C_{1Z}$ linear, branched, cyclic or aromatic hydrocarbon moiety; and $[A\text{-}O]_x$-A wherein A is a $C_2$-$C_9$ linear, branched, cyclic or aromatic hydrocarbon moiety and x is an integer from 1 to 200;

Z is a $C_1$-$C_6$ alkylene chain;

M is selected from H, $C_1$-$C_{20}$ linear, branched, cyclic or aromatic hydrocarbon moieties and from alkali, earth alkali and ammonium ions and from protonated amines;

W is selected from H, $ZPO_3M_2$ and $[V—N(K)]_nK$, wherein V is selected from: a $C_2$-$C_{50}$ linear, branched, cyclic or aromatic hydrocarbon moiety, optionally substituted by $C_1$-$C_{12}$ linear, branched, cyclic or aromatic groups, (which moieties and/or groups are) optionally substituted by OH, COOH, F, OR' or SR' moieties wherein R' is a $C_1$-$C_{12}$ linear, branched, cyclic or aromatic hydrocarbon moiety; and from $[A\text{-}O]_x$-A wherein A is a $C_2$-$C_9$ linear, branched, cyclic or aromatic hydrocarbon moiety and x is an integer from 1 to 200; and K is $ZPO_3M_2$ or H and n is an integer from 0 to 200;

and wherein T is a moiety selected from the group of:

(i) MOOC—X—N(U)—;

(ii) MOOC—$C(X^2)_2$—N(U)—;

(iii) MOOC—X—S—;

(iv) $[X(HO)_n, (N\text{—}U)_{n'}]_{n''}$;

(v) U—N(U)—$[X\text{—}N(U)]_{n'''}$—;

(vi) D-S—;

(vii) CN—;

(viii) MOOC—X—O—;

(ix) MOOC—$C(X^2)_2$-0-;

(x) NHR"—; and (xi) $(DCO)_2$—N—;

wherein M, Z, W and X are as defined above; U is selected from linear, branched, cyclic or aromatic $C_1$-$C_{12}$ hydrocarbon moieties, H and X—N(W)($ZPO_3M_2$); $X^2$ is independently selected from H, linear, branched, cyclic or aromatic $C_1$-$C_{20}$ hydrocarbon moieties, optionally substituted by $C_1$-$C_{12}$ linear, branched, cyclic or aromatic hydrocarbon groups, optionally substituted by OH, COOH, R' O, R'S and/or $NH_2$ moieties; n', n" and n"' are independently selected from integers of from 1 to 100; D and R" are independently selected from $C_1$-$C_{50}$ linear, branched, cyclic or aromatic hydrocarbon moieties, optionally substituted by a $C_1$-$C_{12}$ linear, branched, cyclic, or aromatic group, (which moiety and/or which group can be) optionally substituted by OH, COOH, F, OR' and SR' moieties, wherein R' is a $C_1$-$C_{12}$ linear, branched, cyclic or aromatic hydrocarbon moiety; and A' O-$[A\text{-}O]_x$-A wherein A is a $C_2$-$C_9$ linear, branched, cyclic or aromatic hydrocarbon moiety, x is an integer from 1 to 200 and A' is selected from $C_1$-$C_{50}$ linear, branched, cyclic or aromatic hydrocarbon moiety, optionally substituted by a $C_1$-$C_{12}$ linear, branched, cyclic, or aromatic group, (which moiety and/or which group can be) optionally substituted by OH, COOH, F, OR' and SR' moieties, wherein R' has the meaning given above; with the further proviso that D can also be represented by H;

(IV) linear or branched hydrocarbon compounds having from 6 to $2\times10^6$ carbon atoms containing amino groups substituted by alkylene phosphonic acid substituents and/or —X—N(W)($ZPO_3M_2$), with respect to the hydrocarbon group, in either terminal or branched positions whereby the molar ratio of the aminoalkylene phosphonic acid substituents to the number of carbon atoms in the hydrocarbon group is in the range of from 2:1 to 1:40 whereby at least 30% of the available NH functionalities have been converted into the corresponding aminoalkylene phosphonic acid and/or into —X—N(W) ($ZPO_3M_2$) substituted groups and wherein the alkylene moiety is selected from $C_{1\text{-}6}$; and X, W, Z and M have the same meaning as given above; and (V) alkylamino alkylene phosphonic acids having the formula:

$$Y\text{—}[X\text{—}N(W)(ZPO_3M_2)]_s$$

the structural elements having the following meaning:

X is selected from $C_2$-$C_{50}$ linear, branched, cyclic or aromatic hydrocarbon moieties, optionally substituted by a C1-C12 linear, branched, cyclic, or aromatic group, (which moiety and/or which group can be) optionally substituted by OH, COOH, F, OR', $R^2O[A\text{-}O]_x$— wherein $R^2$ is a $C_1$-$C_{50}$ linear, branched, cyclic or aromatic hydrocarbon moiety, and SR' moieties, wherein R' is a $C_1$-$C_{50}$ linear, branched, cyclic or aromatic hydrocarbon moiety, optionally substituted by $C_1$-$C_{12}$ linear, branched, cyclic or aromatic hydrocarbon groups, (said moieties and/or groups can be) optionally substituted by COOH, OH, F, OR' and SR'; and $[A\text{-}O]_x$-A wherein A is a $C_2$-$C_9$ linear, branched, cyclic or aromatic hydrocarbon moiety and x is an integer from 1 to 200;

Z is a $C_1$-$C_6$ alkylene chain;

M is selected from H, $C_1$-$C_{20}$ linear, branched, cyclic or aromatic hydrocarbon moieties and from alkali, earth alkali and ammonium ions and from protonated amines;

W is selected from H, $ZPO_3M_2$ and $[V\text{—}N(K)]_nK$, wherein V is selected from: a $C_2$-$C_{50}$ linear, branched, cyclic or aromatic hydrocarbon moiety, optionally substituted by $C_1$-$C_{12}$ linear, branched, cyclic or aromatic groups, (which moieties and/or groups can be) optionally substituted by OH, COOH, F, OR',$R^2O[A\text{-}O]_x$— wherein $R^2$ is a $C_1$-$C_{50}$ linear, branched, cyclic or aromatic hydrocarbon moiety, and SR' moieties; and from $[A\text{-}O]_x$-A wherein A is a $C_2$-$C_9$ linear, branched, cyclic or aromatic hydrocarbon moiety and x is an integer from 1 to 200;

K is $ZPO_3M_2$ or H and n is an integer from 0 to 200; and

Y is a moiety selected from $NH_2$, NHR', $N(R')_2$, NH, N, OH, OR', S, SH, and S—S wherein R' is as defined above with the proviso that when Y is OH or OR', X is, at least, $C_4$; and s is 1 in the event Y stands for $NH_2$, NHR', $N(R')_2$, HS, OR', or OH; s is 2 in the event Y stands for NH, NR', S or S—S; and s is 3 in the event Y stands for N.

2. The composition in accordance with claim 1, where component (b) is selected from group (II) and $A^2$ is L-lysine, wherein L-lysine carrying one alkylene phosphonic acid group attached to amino radical(s) represents not more than 20 mole % of the sum of L-lysine carrying one and two alkylene phosphonic acid groups attached to amine radicals.

3. The composition in accordance with claim 1, where component (b) is selected from group (II) and $A^2$ is L-lysine, wherein the L-lysine alkylene phosphonic acid is represented by a mixture of L-lysine carrying two alkylene phosphonic acid groups attached to amino radical (lysine di) and L-lysine carrying four alkylene phosphonic acid groups (lysine tetra) whereby the weight ratio of lysine tetra to lysine di is in the range of from 9:1 to 1:1.

4. The composition in accordance with claim 1 wherein the surfactant agent, is selected from the group of cationic, nonionic, anionic, ampholytic and zwitterionic surfactants and mixtures thereof, and is present in a level of from 2 to 40% by weight (based on the total composition).

5. The composition in accordance with claim 1 wherein the phosphonic acid compound is selected from the group of:

(I) and $A^1$ is selected from 7-aminoheptanoic acid;

6-aminohexanoic acid;

5-aminopentanoic acid;

4-aminobutyric acid; and whereby x is 2 in each of such species;

(III) and T is selected from (1) MOOC—X—N(U)—;

(ii) MOOC—$C(X^2)_2$—N(U)—;

(iv) $[X(HO)_n, (N—U)_n]_{n''}$;

(v) $U—N(U)—[X—N(U)]_{n'''}$;

(viii) MOOC—X—O—;

(ix) $MOOC—C(X^2)_2—O—$; and (xi) $(DCO)_2—N—$;

(IV):

amino alkylene phosphonic acids characterized by a molar ratio of amino alkylene phosphonic acid sustituents to carbon atoms in the hydrocarbon group of from 2:1 to 1:8, said hydrocarbon chain containing of from 6 to 500000 carbon atoms; and (V):

wherein U is a moiety selected from $NH_2$, NHR', $N(R')_2$, NH, NR', N, OH, and OR'.

6. The composition in accordance with claim 1 wherein the phosphonic acid compound is selected from the group (II), $A^2$ is D, L-alanine, and y is 2;

L-alanine, and y is 2;

L-phenylalanine, and y is 2;

L-lysine, and y is in the range from 2 to 4;

L-arginine, and y is in the range from 2 to 6;

L-threonine, and y is 2;

L-methionine, and y is 2;

L-cysteine, and y is 2;

and -L-glutamic acid, and y is 1 to 2.

7. A granular treatment composition in accordance with claim 1 containing a detergent builder in a level of from 2 to 60% by weight (based on the total composition).

8. The composition in accordance with claim 1, wherein surfactant ingredients represent from 2 to 50% by weight (based on the total composition).

9. The composition in accordance with claim 1, wherein surfactant ingredients represent from 3 to 40% by weight (based on the total composition) and the phosphonate ingredient represents from 0.1 to 5% by weight (based on the total composition).

10. A method for treating a surface comprising the step of applying a composition according to claim 1.

11. The method according to claim 10, for application in textile laundry, textile and industrial textile treatment, hard surface treatment, house- and industrial dishwasher applications.

* * * * *